US007455536B2

(12) United States Patent
Virchow

(10) Patent No.: US 7,455,536 B2
(45) Date of Patent: Nov. 25, 2008

(54) CONTACT ELEMENT FOR ELECTRICALLY

(76) Inventor: Florian Virchow, Weingarten 7A, 29223 Celle (DE)

( * ) Notice: Subject to any disclaimer, the term of this patent is extended or adjusted under 35 U.S.C. 154(b) by 0 days.

(21) Appl. No.: 11/248,590

(22) Filed: Oct. 12, 2005

(65) Prior Publication Data

US 2006/0148338 A1 Jul. 6, 2006

(30) Foreign Application Priority Data

Oct. 13, 2004 (DE) ..... 20 2004 015 917 U

(51) Int. Cl.
*H01R 13/44* (2006.01)

(52) U.S. Cl. ..... 439/125

(58) Field of Classification Search ..... 439/125, 439/700, 848
See application file for complete search history.

(56) References Cited

U.S. PATENT DOCUMENTS 965,103 A * 7/1910 Goodridge ..... 439/734
3,378,810 A * 4/1968 Dorrell ..... 439/436
4,904,213 A 2/1990 Hock et al.
5,151,040 A * 9/1992 Tanaka ..... 439/73
5,618,193 A * 4/1997 Nakajima et al. ..... 439/125
5,630,722 A * 5/1997 Mochizuki et al. ..... 439/125
5,681,187 A 10/1997 Fukushima et al.
6,247,943 B1 * 6/2001 Moga et al. ..... 439/125
6,398,592 B1 6/2002 Mori et al.
6,467,447 B1 * 10/2002 Holmes et al. ..... 123/169 PA
2004/0077225 A1 * 4/2004 Chun-Fu ..... 439/700
2004/0161981 A1 8/2004 Matsui et al.
2005/0199411 A1 * 9/2005 Doll ..... 174/86

FOREIGN PATENT DOCUMENTS

DE 27 23 731 A1 11/1978
DE 20 2004 005 435 U1 7/2004

* cited by examiner

*Primary Examiner*—Phuong K Dinh
(74) *Attorney, Agent, or Firm*—Hedman & Costigan, P.C.

(57) ABSTRACT

The object of the invention is a contact element, in particular of ignition voltage parts in internal combustion engines, with an outer sleeve in whose inside an axially acting compression spring is provided.

11 Claims, 2 Drawing Sheets

CONTACT ELEMENT FOR ELECTRICALLY

CROSS REFERENCE TO RELATED APPLICATIONS

The present application claims priority to German Patent Application Serial No. DE20 2004 015917.1, filed on Oct. 13, 2004.

BACKGROUND OF THE INVENTION

The invention relates to a contact element, particularly for ignition voltage parts in internal combustion engines, with an outer sleeve inside which is provided an axially acting compression spring.

When internal combustion engines are operated the ignition of the gas content in the cylinders is brought about by means of ignition sparks which are generated by spark plugs. The ignition voltage required for ignition is generated by an ignition device, an ignition coil, via a rigid connection or an ignition cable.

Contact elements which consist of a sleeve incorporating an axially acting compression spring are used for contacting the spark plug and each voltage feed cable. When placed on the spark plug the compression spring is pressed against the spring pressure into the sleeve. This provides good transient contact between the voltage feeds and the spark plug.

The conventional compression spring of the contact element of prior art is founds from spring strip steel and is displaced out of the sleeve with the end directed toward the spark plug. The compression spring consists of spring bronze or copper.

During operation of the internal combustion engine corona phenomena, which result in corrosion, occur due to the high voltages to be transmitted. Because the compression spring escapes from the sleeve and the inlet port to the inside of the sleeve is therefore open, considerable corrosion occurs on the compression spring. The sleeve, with its compression spring, must be regularly replaced.

SUMMARY OF THE INVENTION

The object of the invention is to provide a contacting sleeve on which less corrosion takes place.

This object is achieved according to the invention by the use of a contacting sleeve according to claim 1. Preferred embodiments constitute the object of the sub-claims or are described below.

The significant feature of this design is that one of the spring ends rests inside the outer sleeve on a first stop, and the other spring end inside the outer sleeve engages in a cup with which this other spring end is displaceable under the action of the spring as far as a second stop still located inside the outer sleeve.

Therefore the spring does not escape from the outer sleeve because the cup seals the outer sleeve on the outside. For this reason the corona effects cannot affect the parts inside the contact element so easily and cannot cause corrosion so easily, particularly on the spring. The displaceable cups allow an equalisation of tolerances.

According to a further embodiment of the invention provision is made for the second stop for the cup to be provided with another spring end on a bush which is inserted in the outer sleeve. The second stop can therefore be assembled after the spring and cup.

According to a further embodiment of the invention provision is made for the bush and outer sleeve to be connected together by means of a screw connection, particularly on the outside diameter of the sleeve and the inside diameter of the outer sleeve.

According to a further embodiment of the invention provision is made for the bush inside the outer sleeve to be extended so that it guides the compression spring in the outer sleeve. The spring windings preferably rest against the inner walls of the bush.

According to a further embodiment of the invention provision is made for a feed section to connect to the end of the outer sleeve with the first stop, which section exhibits an axial hole about which extends a collar which is enclosed by a spring which, with contact pieces, contacts an ignition voltage feed line in the axial hole through wall openings in the collar. The voltage feed line is well contacted.

According to a further embodiment of the invention provision is made for the parts of the contact element consist of any current conducting material, particularly metal. Here all parts of the contact element preferably consist of material insensitive to corrosion.

All parts of the contact element preferably consist of an alloy steel which is marketed under the commercial name of V2A. This material is insensitive to corrosion. Regular replacement because of possible corrosion phenomena is therefore unnecessary.

According to a further embodiment of the invention provision is made for the outer sleeve to be placed on the end of a spark plug serving for contacting with the end in which the cup is displaceable, and for the other end of the outer sleeve to be connected to an ignition voltage feed line.

For this purpose the outer sleeve can preferably be placed on a spark plug with the end in which the cup is displaceable, so that the contact end of the spar plug penetrates the contact element against the mechanical resistance of the spring, when the cup is displaced, and independently of this for the contact end of the spark plug to be designed at least partially tapered so that the surface areas of the outer conical surfaces of the contact end of the spark plug rest on the correspondingly designed inner cup walls at the bottom of the cup.

Furthermore, the ignition voltage is fed directly via an ignition voltage contact of an ignition coil. The entire area of the ignition voltage supply with the ignition voltage contact and the contact element is preferably surrounded by insulating material, apart from at least the cup contact surface which serves for contacting with the spark plug contact.

According to a further embodiment of the invention provision is made for the ignition voltage to be supplied via a resistance element which is located, for example, in a ceramic cover which is in turn enclosed by a cover of a PTFE-based material, for example, wherein one end of the resistance element is connected to the contact element and the other end of the resistance element is connected to a connecting piece to an ignition cable, which is in turn connected to the ignition coil.

According to a further embodiment of the invention provision is made for the connecting piece to be sealed with the ignition cable and the resistance element by means of an insulating material. Similarly, the contact element can also be sealed at least partially with the resistance element by means of an insulating material.

The sealing compound consists in all cases preferably of a two-component epoxy resin.

BREIF DESCRIPTION OF THE DRAWINGS

The invention is explained further with reference to the drawing, in which.

DETAILED DESCRIPTION OF THE INVENTION

Figure 1:
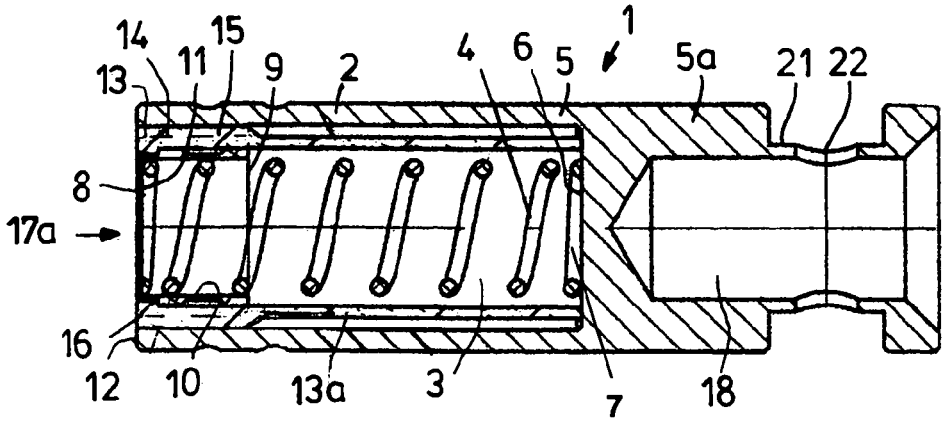
FIG. 1 shows a contacting sleeve according to the invention, in section.
Figure 2:
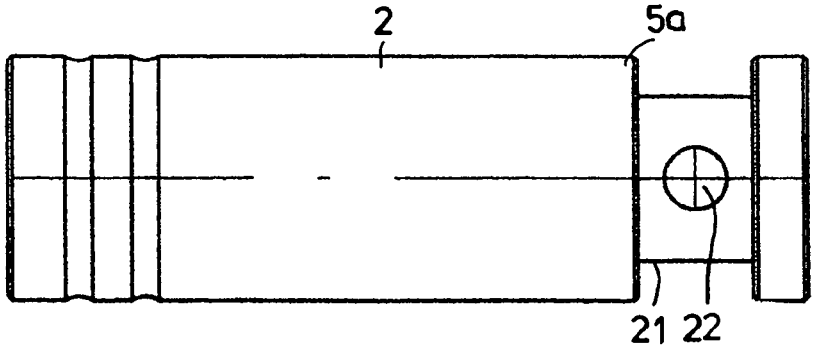
FIG. 2 shows the contacting sleeve according to FIG. 1, in elevation.
Figure 5:
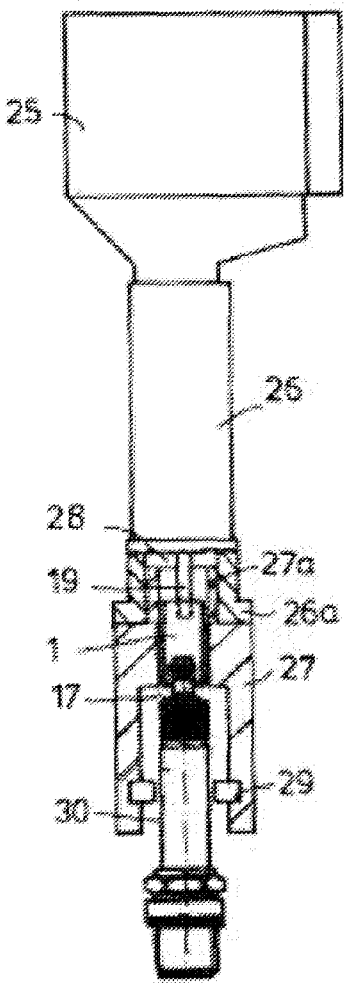
FIG. 5 shows an application of the contacting sleeve with a resistance element and an ignition cable.
Figure 6:
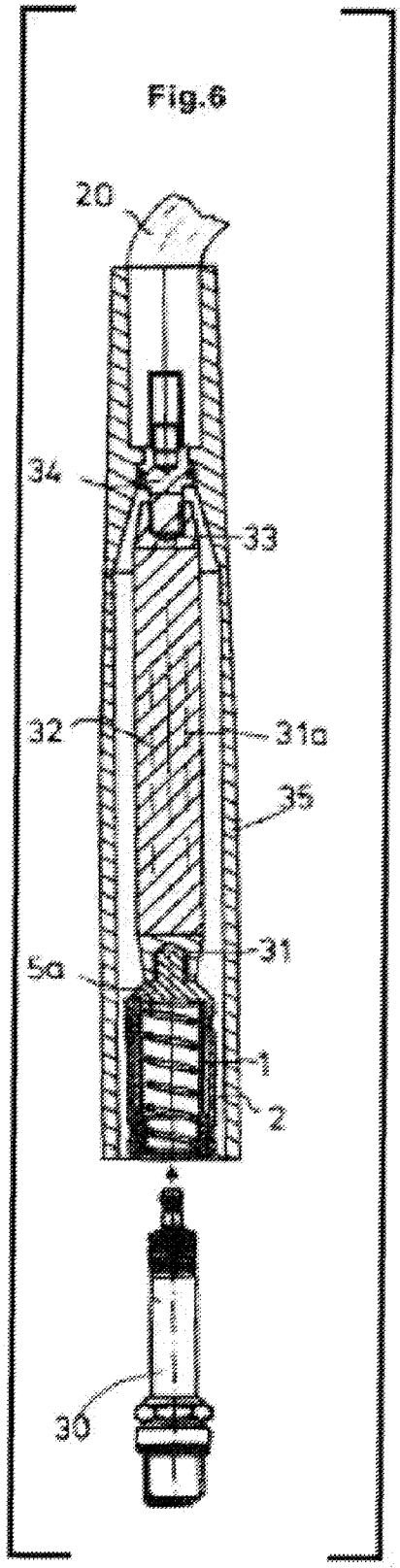
FIG. 6 shows an application connected to a resistance element and an ignition cable.

A contact element 1 shown in FIGS. 1 and 2 serves, for example, to connect a voltage supply to the spark plug. The contact element can of course also be used for other contacting purposes. Examples of contact elements are shown in FIGS. 5 and 6 and are described below.

A compression spring 4 coiled from spring steel wire is located on the inside 3 of an outer sleeve 2 of contact element 1. Outer sleeve 2 passes at one sleeve end 5 into a contact section 5*a* serving as a supply part. At sleeve end 5 outer sleeve 2 is closed and therefore forms a first stop 6 for compression spring 4. Compression spring 4 rests on this first stop 6 with a spring end 7.

The other spring end 8 is located in a cup 9 with a cup wall 10 and a cup bottom 11. Outer sleeve 2 is open in the region of the other spring end 8 before assembly. Compression spring 4 can therefore be inserted with cup 9 in the inside 3 of outer sleeve 2. After insertion, a bush 13 is inserted in the open end 12 of outer sleeve 2. For this purpose bush 13 is provided on its outside 14 with a thread. Correspondingly the inside 15 of outer sleeve 2 is provided with a thread. The threads are not shown because they are not absolutely necessary, for bush 13 is either screwed into outer sleeve 2 by means of the thread or—if no threads are provided—are glued in.

On its inside bush 13 has a second stop 16. This second stop 16 stops bush 13 in outer sleeve 2 from escaping. Bush 13 can be pushed further into outer sleeve 2 against the action of compression spring 4 when a part, e.g. a spark plug contact 17 (FIG. 5), is pressed in in the direction of an arrow 17*a*, thus providing good pressure contact. Vibrations and construction tolerances are eliminated.

Bush 13 is provided on the inside 3 of outer sleeve 2 with an extension 13*a* which is so long that it is able to guide compression spring 4 completely or almost completely over its entire length. Preferably it strikes against the first stop 6 when fully mounted.

Figure 4:
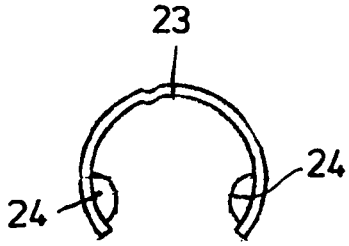
FIG. 4 shows a side view of the clamping spring used.

Contact section 5*a* of outer sleeve 2 exhibits an axial hole 18 into which an ignition voltage contact 19 (FIG. 4) or an ignition cable 20 (FIG. 5) can be inserted for ignition voltage supply. Contact section 5*a* is provided with a collar 21, which exhibits wall openings 22. A connection clamp 23 can be clicked onto collar 21. Contact pieces 24 of connection clamp 23 engage through wall openings 22. An ignition cable inserted in hole 18 or an inserted ignition voltage contact 19 is therefore contacted and retained in a corresponding collar.

Figure 3:
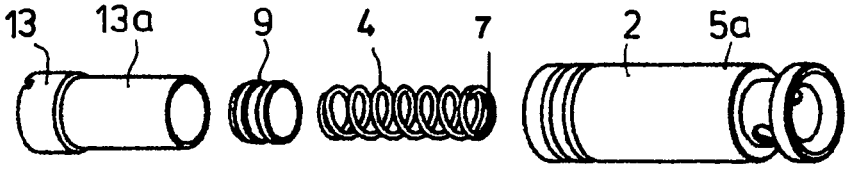
FIG. 3 shows the individual parts of the contacting sleeve, in an exploded view.

FIG. 3 shows the component parts of contact element 1 such as outer sleeve 2 with contact section 5*a*, compression spring 4, cup 9, bush 13 with extension 13*a*, in an exploded view. All these parts 2, 5*a*, 4, 13 and 13*a* consist of any electrically conducting material. This electrically conducting material may be copper, for example. A material insensitive to corrosion is preferably considered. Preference is given to an alloy steel which is available commercially under the name V2A or V4A. spring clamp 23 also consists preferably of V2A or V4A steel.

FIG. 5 shows one embodiment of contact element 1. An ignition coil 25 exhibits a bar-shaped insulating element 26 through which ignition voltage contact 19 serving to supply the ignition voltage runs axially. An adapter 27, which engages in the inside 28 of insulating element 26, with a support sleeve 27*a*, is placed on the lower end 26*a* (in the drawing) of insulating element 26. Adapter 27 preferably consists of silicon and guides contact element 1. A support ring 29 serves to guide a spark plug 30. Spark plug 30, when fully assembled, pushes cup 9 into the inside 3 of outer sleeve 2, thereby generating a higher contact pressure. Contact element 1 is sealed with adapter 27 and ignition voltage contact 19 by means of an insulating compound, preferably by means of a two-component epoxy resin, thus preventing corona effects in this region. Effects triggering oxidation do not influence contact element 1 of V2A steel.

FIG. 6 shows an application of contact element I in which contact element 1 is connected to one end 31 of a resistance denoted by the number 31 a, e.g. an inductive resistance incorporated in a ceramic cover 32. Here the contact section is designed differently from pin 5*a*. A spark plug 30 is pressed into outer sleeve 2 in the application shown in FIG. 5. The other end 33 of the resistance arranged in ceramic cover 32 is contacted with a metal transition piece 34, to which is connected ignition cable 20 as the ignition voltage supply. The entire arrangement is surrounded by a cover 35 of a PTFE-based material. Ignition cable 20 is sealed with transition piece 34 and ceramic resistance 32 by means of an insulating material. Similarly, contact element 1 is sealed with ceramic resistance 32 by means of an insulating material, apart from the contact face of cup 9. A two-component epoxy resin is preferably used as sealing compound.

Figure 7:
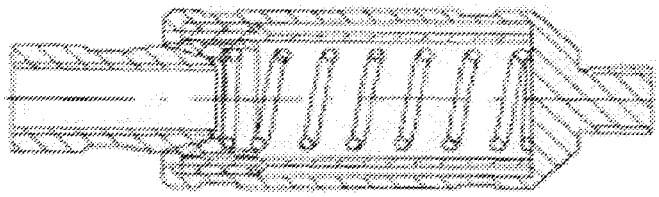
FIG. 7 shows the contacting sleeve with immersed spark plug contact.

FIG. 7 shows how the contact end of a spark plug penetrates the contact element against a mechanical resistance, with displacement of the cup, and how the contact end of the spark plug is designed at least partially tapered so that the surface areas of the conical surfaces of the contact end rest upon the correspondingly shaped inner cup walls at the bottom of the cup.

The invention claimed is:

1. A contact element for electrically contacting ignition components, said contact element comprising a hollow outer sleeve, a hollow bush, a hollow cup and an axially acting compression spring, wherein said hollow outer sleeve comprises inner walls and an open end, said inner walls comprise a first stop opposite to said open end;

wherein said hollow bush is inserted in said open end of said hollow outer sleeve;

wherein said hollow cup further comprises a cup bottom and a contact face; and wherein said hollow cup is displaceable within said bush under or against the action of said axially acting compression spring until a second stop in the hollow bush, said compression spring comprising first and second spring ends; wherein said first spring end contacts said first stop inside said hollow outer sleeve; and said second spring end contacts said cup bottom;

characterized in that a contact end of said hollow outer sleeve comprises an axial hole, said contact end further comprising a collar surrounding said axial hole, said collar comprising wall openings in said collar and a spring clamp surrounding said collar, wherein said spring clamp connects to said collar at said wall openings.

2. A spark plug attachment comprising a spark plug and a contact element, said spark plug further comprising a contact end; and wherein said contact element comprises a hollow outer sleeve, a hollow bush, a hollow cup and an axially acting compression spring, wherein said hollow outer sleeve comprises inner walls and an open end, said inner walls comprise a first stop opposite to said open end;

wherein said hollow bush is inserted in said open end of said hollow outer sleeve;

wherein said hollow cup further comprises a cup bottom and a contact face, and wherein said hollow cup is displaceable within said bush under or against the action of said axially acting compression spring until a second stop in the hollow bush;

said compression spring comprising first and second spring ends; wherein said first spring end contacts said first stop inside said hollow outer sleeve; and said second spring end contacts said cup bottom;

wherein said outer sleeve contacts a high voltage ignition supply, wherein the contact end of the spark plug contacts the contact face of the hollow cup and the spark plug displacing the hollow cup is penetrated into the hollow bush.

3. The spark plug attachment according to claim 2, characterized in that said contact element, apart from said contact face of said hollow cup, is surrounded and sealed by insulating material.

4. The spark plug attachment according to claim 2, characterized in that said ignition voltage supply is provided via a resistance element, wherein said resistance element comprises a first end and a second end, and wherein said first end of said resistance element is connected to said contact element and said second end of said resistance element is connected via a connecting piece to an ignition cable.

5. The spark plug attachment according to claim 4, characterized in that said connecting piece and said resistance element are surrounded and sealed by an insulating material.

6. The spark plug attachment according to claim 5 characterized in that said insulating material consists of a two-component epoxy resin.

7. The spark plug attachment according to claim 2, characterized in that said contact element with the exception of said contact face of said hollow cup is surrounded by a fluorinated polymer material.

8. The spark plug attachment according to claim 2, characterized in that said spark plug attachment comprises a lower insulating sleeve which surrounds at least an upper section of said spark plug wherein said contact element contacts said spark plug contact within said lower insulating sleeve.

9. The spark plug attachment according to claim 2, characterized in that said spark plug attachment comprises a resistance element.

10. A contact element for electrically contacting ignition components, said contact element comprising a hollow outer sleeve, a hollow bush, a hollow cup and an axially acting compression spring, wherein said hollow outer sleeve comprises inner walls and an open end, said inner walls comprise a first stop opposite to said open end;

wherein said hollow bush is inserted in said open end of said hollow outer sleeve;

wherein said hollow cup further comprises a cup bottom and a contact face; and wherein said hollow cup is displaceable within said bush under or against the action of said axially acting compression spring until a second stop in the hollow bush, said compression spring comprising first and second spring ends; wherein said first spring end contacts said first stop inside said hollow outer sleeve; and said second spring end contacts said cup bottom, characterized in that said hollow bush axially does not extend beyond said open end of said hollow outer sleeve.

11. The spark plug attachment according to claim 10, characterized in that said hollow bush axially does not extend beyond said open end of said hollow outer sleeve.

* * * * *